US007245864B2

(12) United States Patent
Fujiwara

(10) Patent No.: US 7,245,864 B2
(45) Date of Patent: Jul. 17, 2007

(54) COLOR IMAGE FORMING APPARATUS IN WHICH TONER ON INTERMEDIATE TRANSFER MEMBER HAVING PREDETERMINED RANGE OF LOSS TANGENT IS REMOVED BY BLADE MEMBER

(75) Inventor: Motohiro Fujiwara, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 10/924,984

(22) Filed: Aug. 25, 2004

(65) Prior Publication Data

US 2005/0047833 A1 Mar. 3, 2005

(30) Foreign Application Priority Data

Aug. 27, 2003 (JP) ..... 2003-302231

(51) Int. Cl.
*G03G 21/00* (2006.01)

(52) U.S. Cl. ..... 399/302; 399/308; 399/350

(58) Field of Classification Search ..... 399/297, 399/302, 308, 350
See application file for complete search history.

(56) References Cited

U.S. PATENT DOCUMENTS

| | | | | |
|---|---|---|---|---|
| 5,532,101 | A * | 7/1996 | Nozawa et al. | 399/297 |
| 5,907,746 | A * | 5/1999 | Kubota | 399/101 |
| 6,456,820 | B1 * | 9/2002 | Sato et al. | 399/350 |
| 6,603,932 | B2 * | 8/2003 | Katayanagi et al. | 399/21 |
| 6,704,539 | B2 * | 3/2004 | Nakayama | 399/350 |
| 2003/0081971 | A1 * | 5/2003 | Nakayama | 399/350 |

FOREIGN PATENT DOCUMENTS

| | | |
|---|---|---|
| CN | 1233785 A | 11/1999 |
| JP | 11-119620 A | 4/1999 |
| JP | 2000-15714 | 1/2000 |
| JP | 2000-62933 | 2/2000 |

(Continued)

OTHER PUBLICATIONS

Machine translation of Japanese Patent JP 2003215995.*

*Primary Examiner*—David M. Gray
*Assistant Examiner*—Ruth N. LaBombard
(74) *Attorney, Agent, or Firm*—Fitzpatrick, Cella, Harper & Scinto

(57) ABSTRACT

An image forming apparatus provided with an image bearing member bearing a toner image, the loss tangent tan δ1 of the image bearing member being 0.05≦tan δ1≦0.40, a transfer member for transferring the toner image borne on the image bearing member to a recording medium, a blade member of which the edge contacts with the image bearing member and removes toner residual on the image bearing member after the toner image has been transferred from the image bearing member to the recording medium, the loss tangent of the blade member being tan δ2, wherein the loss tangent tan δ1 is measured by the use of a first test piece formed by cutting off a portion of the image bearing member, the first test piece includes a surface contacting with the blade member, the loss tangent tan δ2 of the blade member is measured by the use of a second test piece formed by cutting off a portion of the blade member, the second test piece includes the edge contacting with the image bearing member, and two surfaces forming the edge, and the relation that 0.25≦tan δ1+tan δ2≦0.65 is satisfied.

2 Claims, 6 Drawing Sheets

FOREIGN PATENT DOCUMENTS

| | | | |
|---|---|---|---|
| JP | 2002-156879 | A | 5/2002 |
| JP | 2003-21995 | | 1/2003 |
| JP | 2003-12213 | | 4/2003 |
| JP | 2003-177646 | A | 6/2003 |
| JP | 2003-263073 | | 9/2003 |
| JP | 2004-93864 | | 3/2004 |
| JP | 2004-117459 | | 4/2004 |

* cited by examiner

COLOR IMAGE FORMING APPARATUS IN WHICH TONER ON INTERMEDIATE TRANSFER MEMBER HAVING PREDETERMINED RANGE OF LOSS TANGENT IS REMOVED BY BLADE MEMBER

BACKGROUND OF THE INVENTION

1. Field of the Invention

The invention relates to a color image forming apparatus in which a toner on an intermediate transfer member having a predetermined range of loss tangent is removed by a blade member.

2. Related Background Art

In recent years, even in a color image forming apparatus using an electrophotographic process, it has been required to cope with various recording media. Therefore, use is widely made of a color image forming apparatus using an intermediate transfer member capable of coping with various recording media.

Heretofore, as an intermediate transfer member, use has been widely made of one of a single-layer construction of polyimide resin.

However, when a toner image borne on a photosensitive member is transferred to the intermediate transfer member of a single-layer construction of polyimide resin, there occurs so-called scattering in which the outline of the toner image on the intermediate transfer member becomes blurred. When the toner image on the image bearing member is being transferred, the intermediate transfer belt contacts with the image bearing member. At this time, in the outline portion of the toner image on the image bearing member, a gap is caused between the intermediate transfer member and the image bearing member by the thickness of the toner image. Due to the presence of this gap, scattering occurs.

So, an intermediate transfer member using an elastic material such as rubber has come to be used.

The intermediate transfer member using an elastic material is quickly deformed in conformity with the thickness of the toner image. In the outline portion of the toner image on the photosensitive member, no gap is caused between the intermediate transfer member and the photosensitive member. In this manner, the occurrence of the scattering is suppressed.

Here, the loss tangent (tan δ) is an index indicative of the magnitude of a force which a substance absorbs when deformed, on the basis of the time from after a force has been imparted to the substance until the substance is deformed and is further restored to its original shape.

The greater is the loss tangent (tan δ), the longer becomes the time required from after a force has been imparted to the substance until the substance is deformed.

Conversely, the smaller is the loss tangent (tan δ), the shorter becomes the time from after a force has been imparted to the substance until the substance is deformed. Also, it becomes difficult for the imparted force to be absorbed.

Now, as means for removing any toner residual on the intermediate transfer member after the toner image on the intermediate transfer member has been transferred to a recording medium, use is widely made of a blade member of which the edge contacts with the intermediate transfer member. This is because of its simple construction.

However, when the blade member was used as the means for removing the toner residual on the intermediate transfer member using an elastic material such as rubber, there occurred so-called faulty cleaning in which the residual toner is not removed.

SUMMARY OF THE INVENTION

So, it is an object of the present invention to suppress the occurrence of faulty cleaning when any toner residual on an intermediate transfer member using an elastic material such as rubber is removed by a blade member.

It is another object of the present invention to provide an image forming apparatus provided with:

an image bearing member bearing a toner image thereon and of which the loss tangent tan δ1 is $0.05 \leqq \tan \delta 1 \leqq 0.40$;

transferring means for transferring the toner image borne on the image bearing member to a recording medium; and a blade member of which the edge contacts with the image bearing member and removes any toner residual on the image bearing member after the toner image has been transferred from the image bearing member to the recording medium, and of which the loss tangent is tan δ2, wherein the loss tangent tan δ1 of the image bearing member is measured by the use of a first test piece formed by cutting off a portion of the image bearing member, the first test piece includes a surface contacting with the blade member, the loss tangent tan δ2 of the blade member is measured by the use of a second test piece formed by cutting off a portion of the blade member, the second test piece includes the edge contacting with the image bearing member, and two surfaces forming the edge, and the relation that $0.25 \leqq \tan \delta 1 + \tan \delta 2 \leqq 0.65$ is satisfied.

DESCRIPTION OF THE PREFERRED EMBODIMENTS

Figure 1:
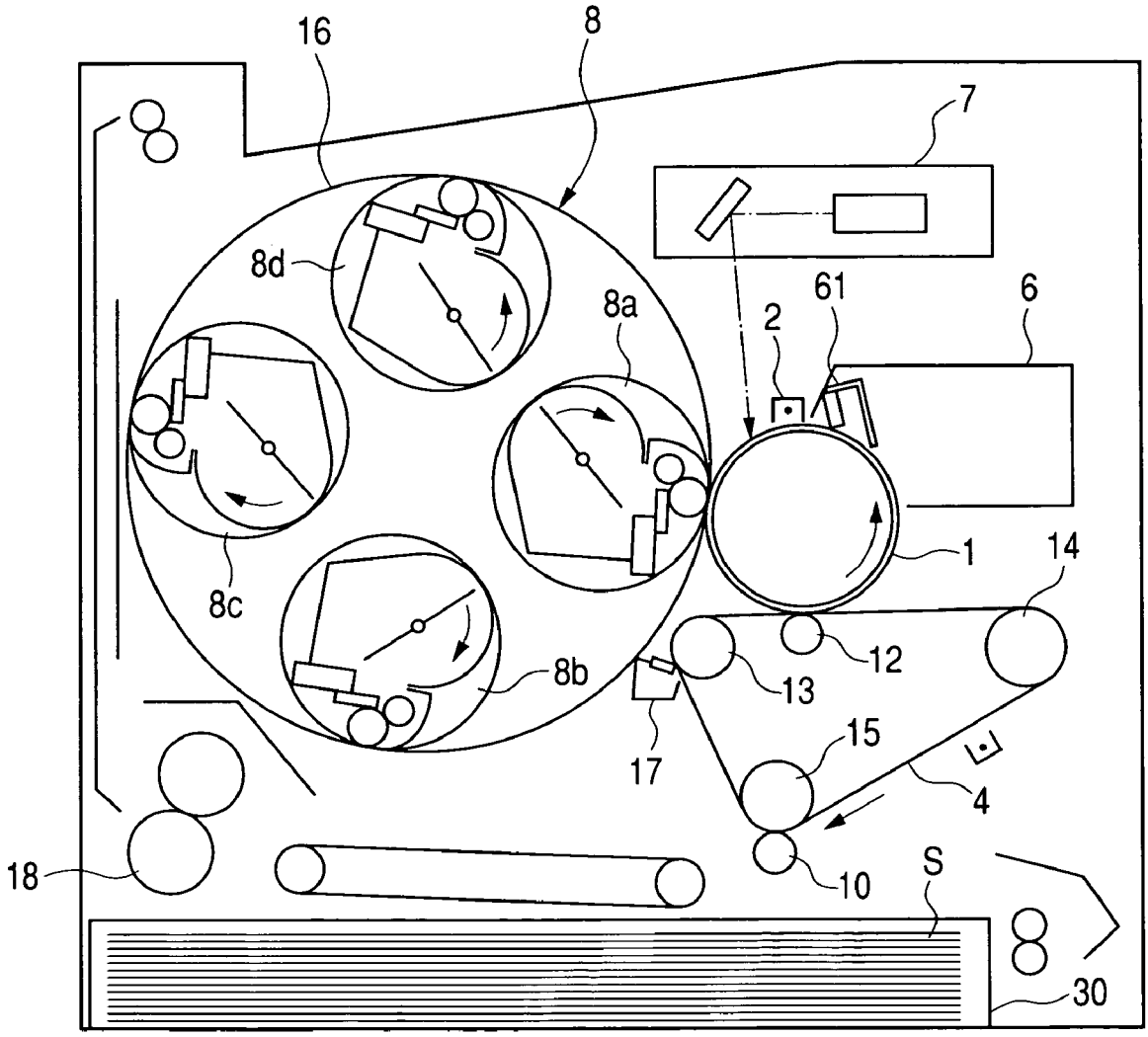
FIG. 1 is a schematic cross-sectional view of an image forming apparatus according to a first embodiment of the present invention.

In the present invention, when the loss tangent of an intermediate transfer member as an image bearing member is defined as tan δ1, and the loss tangent of a blade member was defined as tan δ2, $0.25 \leqq \tan \delta 1 + \tan \delta 2 \leqq 0.65$, whereby the faulty cleaning when any residual toner on the intermediate transfer member using an elastic material was removed by the blade member was suppressed.

Now, in order that the blade member may remove the toner on the intermediate transfer member, it is necessary that the blade member and the intermediate transfer member stably contact with each other and there be not caused a gap through which the residual toner slips out between the blade member and the intermediate transfer member.

However, when use is made of the intermediate transfer member using an elastic material, the intermediate transfer member is deformed with the blade in the portion of contact between the blade member and the intermediate transfer member. The deformed intermediate transfer member and blade member are restored to their original shapes. Thereby, the intermediate transfer member and the blade member are vibrated, and a gap is caused. between the blade member and the intermediate transfer member.

Also, the surface of the intermediate transfer member has unevenness, and if the blade member does not cope with this unevenness and is not quickly deformed, a gap is caused between the blade member and the intermediate transfer member and likewise, faulty cleaning occurs.

In this manner, faulty cleaning occurs.

On the other hand, when an intermediate transfer member of a polyimide resin single-layer construction is used, the intermediate transfer member is not deformed in the portion of contact between the blade member and the intermediate transfer member. Consequently, in a case where intermediate transfer member of a polyimide resin single-layer construction is used, as compared with a case where the intermediate transfer member using an elastic material is used, it is difficult for the vibration of the intermediate transfer belt to occur and it is also difficult for faulty cleaning to occur.

So, in the present embodiment, the loss tangent of the blade member and the loss tangent of the intermediate transfer belt were brought into the above-mentioned relation to thereby prevent the occurrence of faulty cleaning when any residual toner on the intermediate transfer belt using an elastic material was removed by the blade member.

That is, the sum of the loss tangent tan δ1 of the intermediate transfer member and the loss tangent tan δ2 of the blade member is made equal to or less than 0.65, whereby the blade member and the intermediate transfer member are quickly deformed with each other in conformity with the unevenness of the intermediate transfer member, and no gap is caused between the blade member and the intermediate transfer member and faulty cleaning does not occur.

Also, the sum of the loss tangent of the intermediate transfer member and the loss tangent of the blade member is made equal to or less than 0.25, whereby the vibration occurring in the portion of contact between the intermediate transfer member and the blade member is absorbed by the intermediate transfer member and the blade member. At this time, the blade member firmly contacts with the intermediate transfer member and does not cause any gap, and faulty cleaning does not occur.

Some embodiments of the present invention will hereinafter be described in detail.

In the drawings, what are given the same reference characters are members having similar constructions or action, and duplicate description of these will be suitably omitted.

First Embodiment

FIG. 1 is a schematic cross-sectional view of an image forming apparatus according to a first embodiment of the present invention.

(Image Forming Apparatus)

The image forming apparatus shown in FIG. 1 is a copying machine adopting an electrophotographic process, and forms a full-color image on a recording medium in accordance with an image signal sent from a computer, not shown, or the like.

That is, in the image forming apparatus according to the present embodiment, a photosensitive member 1 is uniformly changed by charging means 2, and a light beam is applied from a laser oscillator 7 to this photosensitive member 1 in accordance with the image signal. Thereupon, an electrostatic latent image is formed on that portion of the photosensitive member 1 to which the light beam has been applied, and this electrostatic latent image is developed in developing means 8 by a toner which is a developer and is visualized as a toner image.

An elastic intermediate transfer member 4 is stretched around three rollers 13, 14, 15 below the photosensitive member 1. The intermediate transfer member 4 is pushed against the photosensitive member 1 by a primary transfer roller 12. The visualized toner image on the photosensitive member 1 is transferred onto the intermediate transfer member 4 by applying a transfer voltage to the primary transfer roller 12.

On the other hand, in the developing means 8, a developing rotary 16 is provided with four developing devices 8*a*, 8*b*, 8*c* and 8*d*, in which yellow, magenta, cyan and black toners are contained.

Thus, the electrostatic latent image formed on the photosensitive member 1 is developed with the first color, i.e., yellow toner by the developing device 8*a* opposed to the photosensitive member 1, as shown in FIG. 1, and a yellow toner image is formed, whereupon this yellow toner image, as previously described, is transferred onto an intermediate transfer member 4 by the action of a primary transfer roller 12. Thereafter, the developing rotary 16 is rotated and the color for developing is changed, and the electrostatic latent image on the photosensitive member 1 is developed with the second color, i.e., magenta toner by the next developing device 8*b*, and a magenta toner image is superimposed on and transferred onto the intermediate transfer member 4.

Thereafter, in a similar manner, a cyan toner image developed by the developing device 8*c* and a black toner image developed by the developing device 8*d* are successively superimposed on and transferred onto the intermediate transfer member 4, whereupon a full-color toner image is borne on the intermediate transfer member 4.

When as described above, the toner images of the four colors are superimposed on and transferred onto the intermediate transfer member 4, a sheet S which is a recording medium is fed from a sheet supplying cassette 30 to the region of a secondary transfer roller 10, and the toner images of the four colors are collectively transferred onto the sheet S by the action of the secondary transfer roller 10. Then, the toner images transferred onto the sheet S are fixed on the sheet S with heat and pressure applied thereto by fixing means 18, and a full-color image is formed as a permanent image on the sheet S. Thereafter, any toners residual on the photosensitive member 1 and the intermediate transfer member 4 are removed by the photosensitive member cleaning blade 61 of a photosensitive member cleaning apparatus 6 and an intermediate transfer member cleaning apparatus 17, respectively, and the photosensitive member 1 and the intermediate transfer member 4 having had their surfaces cleaned are again used for image forming.

Now, in the present embodiment, as the photosensitive member 1, use is made of an organic photoconductor (OPC photosensitive member) having applied thereto a charge generating layer using titanylphthalocyanine pigment and a charge transport layer with bisphenol Z type polycarbonate as a binder, but an A-Si photosensitive member or an Se photosensitive member may also be used.

Also in the present embodiment, a mixture of a polymerization toner formed as a toner by the use of styrenepolyester including ester wax in a core and made with styrenebutylacrylate as a resin layer and a surface layer made by suspension polymerization, and a resin magnetic carrier made by polymerization is used as a two-component developer.

Description will now be made of the intermediate transfer member cleaning apparatus (hereinafter simply referred to as the "cleaning apparatus") 17 according to the present invention.

(Cleaning Apparatus)

Figure 2:
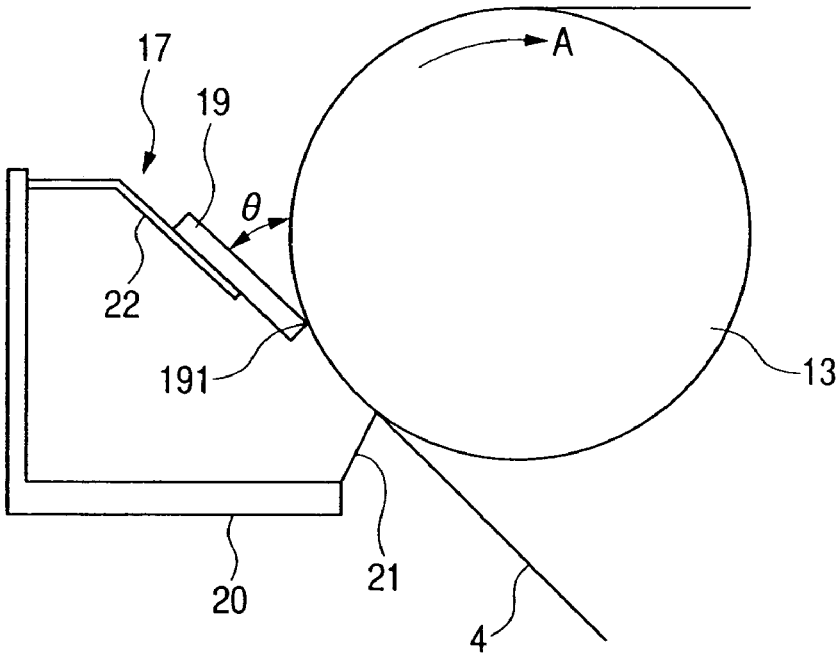
FIG. 2 is a side cross-sectional view of a cleaning apparatus according to the present invention.

FIG. 2 is a side cross-sectional view of the cleaning apparatus 17, and as shown in FIG. 2, the cleaning apparatus 17 is provided with a casing 20 having an opening portion on the side thereof adjacent to the intermediate transfer member 4, and a cleaning blade 19 as a blade member is mounted in the opening portion of the casing 20 by a supporting member 22. The cleaning blade 19 has one side edge 191 thereof abutting against the intermediate transfer member 4, and when the residual toner which could not be completely transferred onto the sheet S by the secondary transfer roller 10 reaches the edge 191 of the cleaning blade 19, this residual toner is scraped off from the intermediate transfer member 4 by the edge 191 of the cleaning blade 19. The details of the cleaning blade 19 will be described later.

Also, a dip sheet 21 is attached to the lower portion of the casing 20, and this dip sheet 21 performs the function of causing the toner scraped off from the intermediate transfer member 4 by the cleaning blade 19 to fall into the casing 20, and preventing the scraped-off toner from flowing back in a great deal to the intermediate transfer member 4.

Although not shown, carrying means for discharging the residual toner is disposed in the casing 20, and the residual toner having fallen into the casing 20 is carried in a direction perpendicular to the plane of the drawing sheet of FIG. 2 by the carrying means and is discharged from the cleaning apparatus 17. Therefore, it never happens that the interior of the casing 20 is dogged with the residual toner.

Here, as the abutting condition of the cleaning blade 19 against the intermediate transfer member 4, it is desirable that the abutting pressure of the cleaning blade 19 against the surface of the intermediate transfer member 4 be line pressure N (g/cm) of $20<N<60$, and preferable $25 \leqq N \leqq 55$.

Incidentally, when the line pressure N of the cleaning blade 19 is 20 g/cm or less, the untransferred toner residual on the surface of the intermediate transfer member 4 cannot be sufficiently removed, and the slipping-out of the toner becomes liable to occur and also, the fusion or filming of the toner on the surface of the intermediate transfer member 4 becomes liable to occur.

On the other hand, the line pressure N of the cleaning blade 19 is 60 g/cm or greater, the cleaning property of the toner residual on the intermediate transfer member 4 heightens, but the wear of the surface of the outermost layer of the intermediate transfer member 4 becomes intense and the service life of the intermediate transfer member 4 is reduced.

The above-described line pressure N which is the abutting pressure of the cleaning blade 19 against the intermediate transfer member 4 refers to the total pressure of the cleaning blade 19 against the intermediate transfer member 4 per unit length of the cleaning blade 19. When this total pressure is to be measured, a load converter can be mounted on the intermediate transfer member 4 which is the object of measurement, and the cleaning blade 19 can be urged against the surface of the intermediate transfer member 4, and the load thereof can be measured as the total pressure.

As the cleaning blade 19 in the present embodiment, use is made of one having a portion of a blade 100 made of thermosetting polyester polyurethane resin as a base which contacts with the intermediate transfer member 4 and a portion near it, these portions being immersed in 4,4-diphenylmethaneisocianate (MDI) to thereby harden a portion of the base and make it into a hardened layer.

The hardness of the base material of the cleaning blade 19 in the present embodiment is 50° to 80° (HS), and preferably 65° to 77°, the impact resiliency rate thereof is 10% to 50%, and preferably 30% to 40%, and the plate thickness thereof is 0.5 mm to 4.0 mm, and preferably 1.0 mm to 3.0 mm. Also, the abutting angle (θ in FIG. 2) of the cleaning blade 19 against the intermediate transfer member 4 is 15° to 35°, and preferably 20° to 25°, and the free length thereof is 2 mm to 12 mm, and preferably 5 mm to 10 mm. These values can be suitably adjusted within such a range that the abutting pressure of the cleaning blade 19 against the intermediate transfer member 4 is line pressure N of $20<N<60$ (g/cm). The hardness (HS) of the base material of the cleaning blade 19 is based upon JIS K 6253, and the impact resiliency rate of the base material of the cleaning blade 19 is based upon JIS K 6255.

The cleaning blade 19 used in the present embodiment was made by the following method.

A bridging agent including triethylenediamine catalyst in which 1,4-butanediol and trimethylolpropane were mixed together at a mass ratio of 65:35 was mixed with prepolymer having NCO % of 7.0% manufactured by ethylenebutylene-adipate polyester polyol of weight average molecular weight 2000 and 4,4-diphenylmethanediisocianate so that the molar ratio of hydoxyl group/isocianate group might become 0.9, thereby making a blade 100 made of thermosetting polyester polyurethane resin of international rubber hardness (IRHD) 70°.

Figure 3:
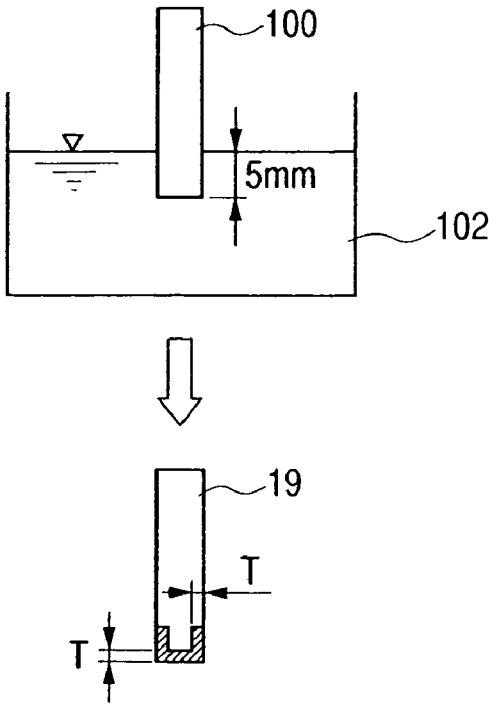
FIG. 3 PRIOR ART
FIG. 3 is a schematic view showing a method of making a cleaning blade.

The obtained blade 100 made of polyurethane resin is left in vacuum for 60 minutes and dried, and moisture in the blade 100 is removed. Next, as shown in FIG. 3, the blade 100 was immersed in 4,4-dephenilmethaneisocianate (MDI) bath 102 of 80° C. by an amount of 5 mm for 3 minutes, whereafter the blade 100 made of polyurethane resin was pulled up from the MDI bath 102, and excess MDI was wiped off to thereby make a cleaning blade 19.

When the cross section of that portion of the obtained cleaning blade 19 abutting against the intermediate transfer member was observed through an optical microscope, the hardened layer was observed as a white turbidity layer, and the thickness T of the hardened layer was 0.7 mm.

Description will now be made of a method of manufacturing the intermediate transfer member 4 used in the present embodiment.

Figure 4:
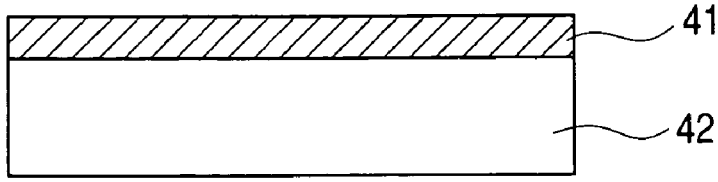
FIG. 4 is a cross-sectional view of the intermediate transfer member of the present invention.

FIG. 4 shows a cross section of the intermediate transfer member 4 in the present embodiment. The intermediate transfer member 4 is a belt member. The outermost layer 41 on which the toner image is borne is formed of resin as a chief component, and a base layer 42 contacting with the primary transfer roller 12 is formed of an elastomer material.

As the chief material used for the outermost layer 41, use can be made of resin or elastomer or the blend of the two, but these are not restrictive. Also, as the chief binder polymer, use can be made of a single component or a blend, and the adjustment of the physical properties thereof may be effected by the addition of a plastic material or the like.

As a specific chief material, polyester resin, or particularly polyesterurethane resin including a certain degree of urethane in polyester is preferable.

As the actual intermediate transfer member 4, electrical resistance adjustment for transferring current control becomes necessary for each of the outermost layer 41 and the base layer 42, and as a resistance adjusting method, it is preferable to use an electrically conductive filler.

As the kind of the electrically conductive filler, any electrically conductive filler usually used can be used, and particularly preferable is a carbon filler such as furnace black, acetylene black, Ketjenblack, graphite or carbon fiber, or an electrically conductive filler of the metal oxide origin typified by the impurity doping material of tin oxide or zinc oxide.

The volume resistivity of the outermost layer 41 should preferably be within the range of $10^7\Omega\cdot$cm to $10^{16}\Omega\cdot$cm. If the volume resistivity is smaller than this range, an excessively great transferring current will flow, and if conversely, the volume resistivity is greater than this range, a sufficient current will not be obtained and therefore, good transfer will not be effected.

Also, the film thickness of the outermost layer 41 is specifically 20 μm to 300 μm, and should be desirably 40 μm to 200 μm, and particularly desirably 80 μm to 150 μm. Incidentally, if the film thickness is greater than 300 μm, the resistance amount of the outermost layer 41 will rise to thereby make the resistance adjustment of the whole of the intermediate transfer member 4 difficult. If conversely, the film thickness is smaller than 20 μm, the strength as film cannot be secured for the outermost layer 41.

As a method of forming the outermost layer 41, there is adopted a method of making the raw material of the outermost layer 41 into paint, and hardening it after formed, and besides a method of forming the outermost layer 41 by spraying or dipping or the like after the forming of the base layer 42, use is made of a method of sticking the discretely formed layers on each other by an adhesive agent or the like. Further, a method of forming the outermost layer 41 in advance by a centrifugal forming method, and subsequently forming the base layer 42 by the same technique is preferable for the reason set forth below.

That is, both of the outermost layer 41 and the base layer 42 are continuously produced by the same facilities and therefore, the cost of the facilities is light and the number of the shifting steps between apparatuses can also be reduced. Also, the base layer 42 in a liquid state is thrown in after the forming of the outermost layer 41 and therefore, according to a combination of appropriate materials, an adhesive agent or the like is not required, and the accuracy of the thickness is also easy to obtain.

As a material used for the base layer 42, mention may be made, for example, styrene-butadiene rubber, high styrene rubber, butadiene rubber, isoprene rubber, ethylene-propylene copolymer, nitrile butadiene rubber chloroprene rubber, butyl rubber, silicone rubber, fluorine rubber, nitrile rubber urethane rubber, acryl rubber, epichlorohydrine rubber, norbornen rubber or the like.

As a method of forming the base layer 42, mention may be made of extrusion molding, centrifugal molding or the like. The film thickness of the base layer 42 should preferably be within the range of 0.5 mm to 2 mm.

A method of making the intermediate transfer member 4 will now be described.

(Making of the Intermediate Transfer Member)

The outermost layer 41 of the intermediate transfer member 4 can be obtained by dissolving 100 parts by weight of polyesterpolyurethane into a solvent (methylethylketone) so that the density of binder polymer may become 20 wt %, adding 10 parts by weight of electrically conductive titanium oxide (trade name: FT-3000, produced by Ishihara Techno (Ltd.)), dispersing it by a paint shaker for 30 minutes, and thereafter drying and molding it by a centrifugal molding machine.

The base layer 42 was made as follows. 100 parts by weight of polyester elastomer (Hytrel(trade mark) 3046, produced by Toray & Du Pont (Ltd.)) was heated to 180° C., and 10 parts of electrically conductive carbon (trade name: Ketjenblack 600JD, produced by Ketjenblack International (Ltd.)) was added thereto and dispersed by an agitating machine for one hour, and 60 parts by weight of MDI isocianate heated to 180° C. was added thereto and dispersed by the agitating machine for 3 minutes, and thereafter was thrown into a centrifugal molding machine after the molding of the outermost layer 41 and heating and burdening were effected. Thereafter, aging was effected under the condition of 80° C. and one hour, and then natural cooling was done to the ordinary temperature, and the material was taken out of the molding machine and end portion cutting was effected to thereby obtain an intermediate transfer member 4. The film thickness of the outermost layer 41 of the obtained intermediate transfer member 4 was 0.14 mm, and the film thickness of the base layer 41 thereof was 1.86 mm.

The loss tangent of the intermediate transfer member 4 was measured by the use of a viscoelasticity measuring apparatus RSA2 (produced by Rheometrics Co.), and assuming that the loss tangent of 30° C. at 10 Hz is tan δ1, tan δ1 was 0.25.

When as previously described, tan δ1 of the intermediate transfer member 4 is low, the absorbed amount of vibration energy in the intermediate transfer member 4 becomes small, and the energy of the behavior of the cleaning blade 19 cannot be absorbed by the intermediate transfer member 4, and the vibration of the cleaning blade 19 becomes excessively great.

In such a case, the cleaning blade 19 and the intermediate transfer member may excessively separate from each other and at that time, faulty cleaning occurs.

On the other hand, when tan δ1 of the intermediate transfer member 4 is great, much time is required until the intermediate transfer member 4 itself is deformed in conformity with the unevenness of the surface of the intermediate transfer member 4, and a gap is caused between the cleaning blade 19 and the intermediate transfer member 4 and faulty cleaning occurs.

tan δ1 of the intermediate transfer member 4 has been described above, and next, the loss tangent of the cleaning blade 19 is defined as tan δ2, and description will hereinafter be made of the point that this tan δ2 is adjusted to thereby control the absorbed amount of the energy of the behavior of the cleaning blade 19.

Even when tan δ1 of the intermediate transfer member 4 is low and the vibration of the cleaning blade 19 is liable to become excessive, if tan δ2 of the cleaning blade 19, and particularly tan δ2 of the cleaning blade 19 in the vicinity of the abutting portion thereof is made great, the absorbed amount of the vibration energy of the cleaning blade 19 will become great and moderate behavior can be achieved.

Even when conversely, tan δ1 of the intermediate transfer member 4 is great and the vibration of the cleaning blade 19 is liable to become small, if tan δ2 of the cleaning blade 19, and particularly tan δ2 of the cleaning blade 19 in the vicinity of the abutting portion thereof is made small, the absorbed amount of the vibration energy of the cleaning blade 19 will become small and moderate behavior can be achieved.

Description will hereinafter be made in greater detail.

The vibration amount of the intermediate transfer member 4 at the blade abutting position ∞ the vibration energy absorption rate in the intermediate transfer member 4 ∞ tan δ1 of the intermediate transfer member 4, and The vibration amount of the cleaning blade 19 at the drum abutting position ∞ the vibration energy absorption rate in the cleaning blade 19 ∞ tan δ2 of the cleaning blade 19 in the vicinity of the abutting portion hold good when considered from the definition or the like of loss tangent.

On the other hand, the vibration amounts of the intermediate transfer member 4 and the cleaning blade 19 at the abutting portion are proportional to the sum of the vibration amount of the intermediate transfer material 4 at the blade abutting position and the vibration amount of the cleaning blade 19 at the drum abutting position as long as the cycles of the vibration of the intermediate transfer member 4 and the cleaning blade 19 do not completely coincide with each other and the phases thereof do not become completely opposite to each other.

Accordingly, the vibration amounts of the intermediate transfer member 4 and the cleaning blade 19 at the abutting portion ∞ tan δ1 of the intermediate transfer member 4+tan δ2 of the cleaning blade 19 in the vicinity of the abutting portion holds good.

What have made loss tangent proper with these taken into account are the intermediate transfer member 4 and the cleaning blade 19 in the present embodiment.

Hereinbelow, as comparative examples, the cleaning blade 19 and the intermediate transfer. member 4 were variously changed to thereby inspect the loss tangent tan δ2 of the cleaning blade 19, the loss tangent tan δ1 of the intermediate transfer member 4, the scattering during the transfer from the photosensitive member 1 to the intermediate transfer member, and the presence or absence of faulty cleaning.

The loss tangent tan δ2 of the cleaning blade 19 was measured as follows.

Figure 5:
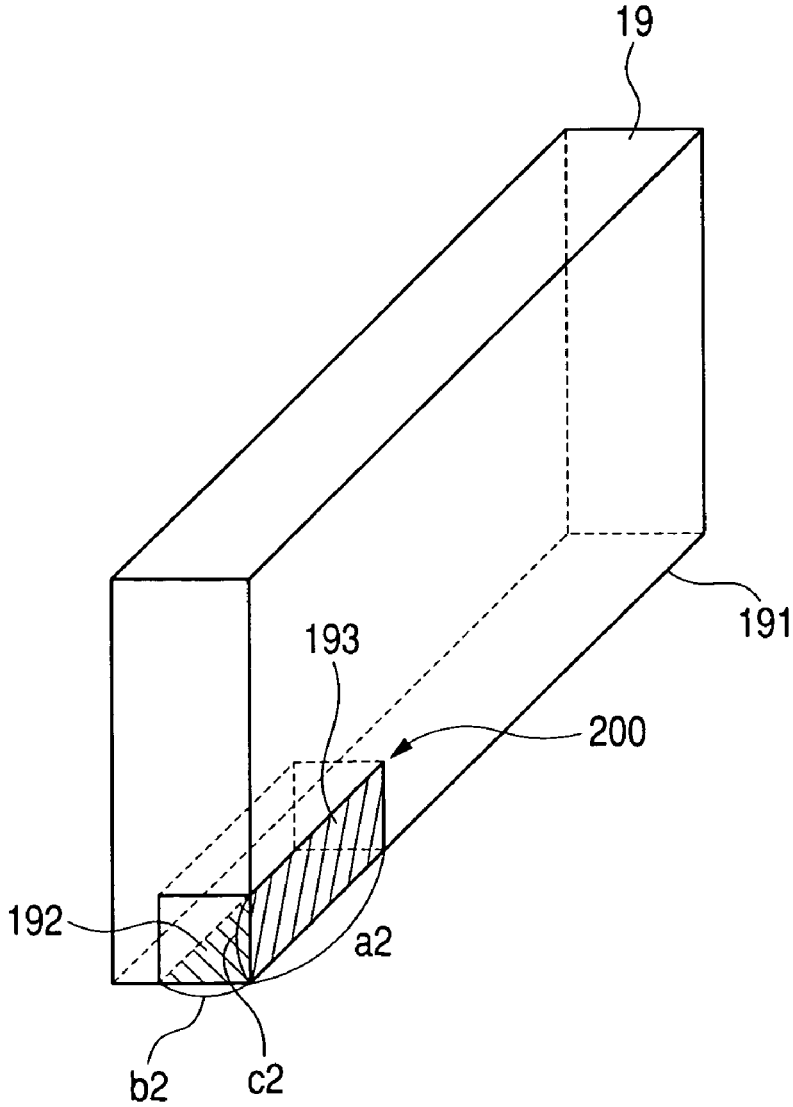
FIG. 5 shows a test piece for measuring the loss tangent tan δ2 of the cleaning blade of the present invention.

As shown in FIG. 5, measurement is effected by the use of a test piece 200 formed by cutting off a portion of the cleaning blade 19. It is to be understood that the test piece 200 has at least an edge 191 for contacting with the intermediate transfer member, two surfaces (192, 193) forming the edge 191, a surface parallel to the surface 192, a surface parallel to the surface 193, and two surfaces perpendicular to the aforementioned four surfaces (the surface 192, the surface parallel to the surface 192, the surface 193 and the surface parallel to the surface 193).

Let it be assumed that the length of a direction a2 parallel to the edge 191 is 10 mm. Let it be assumed that the lengths (b2 and c2) of directions perpendicular to the edge 191 in the two surfaces (192 and 193) constituting the edge 191 are 2 mm.

The reason why it is assumed that b2 and c2 are 2 mm is that it has become apparent from my study that when the cleaning blade 19 removes the toner on the intermediate transfer member 4, the edge 191 and the two surfaces (192 and 193) forming the edge 191 vibrate and further, b2 and c2 vibrate within the range of 2 mm.

Figure 6:
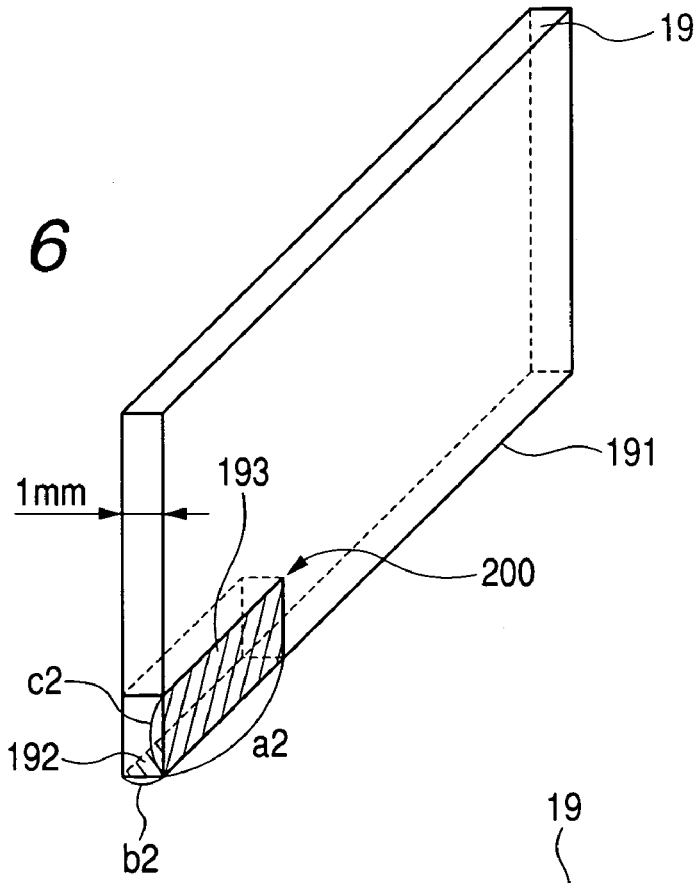
FIG. 6 shows a test piece of another shape for measuring the loss tangent tan δ2 of the cleaning blade of the present invention.

It is to be understood that as shown in FIG. 6, the lengths b2 and c2 in a direction perpendicular to the edge 191 on the two surfaces (192 and 193) forming the edge 191, when they are less than 2 mm, are the lengths in the direction perpendicular to the edge on the surface 192 and surface 193 of the cleaning blade 19 itself.

The cleaning blade 19 shown in FIG. 6 is 1 mm in the direction perpendicular to the edge on the surface 192. In the test piece 200 of the cleaning blade 19 of FIG. 6, a2=10 mm, b2=1 mm and c2=2 mm.

Figure 7:
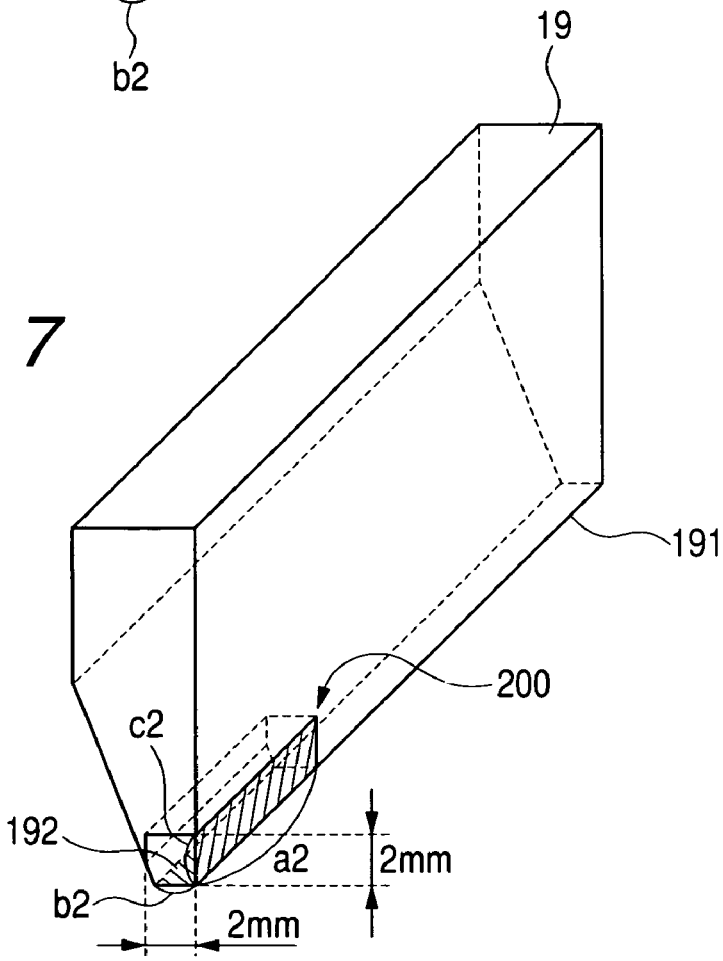
FIG. 7 shows a test piece of still another shape for measuring the loss tangent tan δ2 of the cleaning blade of the present invention.

Also, when the shape of the cleaning blade 19 is a shape as shown in FIG. 7 wherein a portion of a rectangular parallelepiped is cut off, it is to be understood that the cleaning blade is cut off to a width of 2 mm in the direction perpendicular to the edge 191 on each of the two surfaces (192 and 193) forming the edge 191. The loss tangent tand2 is measured by the use of the viscoelasticity measuring apparatus RSA2 (produced by Rheometrics Co.).

The temperature of the test piece is kept at 30° C., and vibration of 10 Hz is added in a direction parallel to the edge portion and the loss tangent tan δ2 is measured.

As a test condition, the frequency of the vibration applied was 10 Hz, and this was made substantially equal to the frequency of the intermediate transfer member 4 and the cleaning blade 19 in the portion of contact between the intermediate transfer member 4 and the cleaning blade 19 during the use of the image forming apparatus.

This value is determined by the various conditions of the intermediate transfer member 4 and the cleaning blade 19 and therefore should desirably be suitably changed in conformity with them. In my experiment, however, the order of 10 Hz was suitable in almost any and all cases and therefore, the experiment was carried out with the value fixed at 10 Hz.

Also, it is necessary to pay attention to the loss tangent at the used temperature of the vicinity of the intermediate transfer member 4 and the cleaning blade 19 in the image forming apparatus. This was substantially in the vicinity of 30° C. and therefore, in the present invention, the experiment was carried out with the test piece kept at 30° C. Measurement was effected in a state in which the atmospheric temperature during the measurement was 30° C. and the test piece was at the same temperature as the atmospheric temperature.

Ideally, however, it is more desirable to change the aimed-at temperature in conformity with the use environment or the like.

Next, there will be shown a method of measuring the loss tangent tan δ1 of the intermediate transfer member 4.

The loss tangent tan δ1 of the intermediate transfer member 4 is measured by the use of a test piece 210 formed by cutting off a portion of the intermediate transfer member 4. It is to be understood that this test piece 210 includes at least a surface X for contacting with the cleaning blade 19, a surface Y perpendicular to the surface X for contacting with the photosensitive member 1, a surface parallel to the surface X, a surface parallel to the surface Y, and two surfaces perpendicular to the aforementioned four surfaces (the surface X for contacting with the photosensitive member 1, the surface Y perpendicular to the surface X for contacting with the photosensitive member 1, the surface parallel to the surface X, and the surface parallel to the surface Y).

Figure 8:
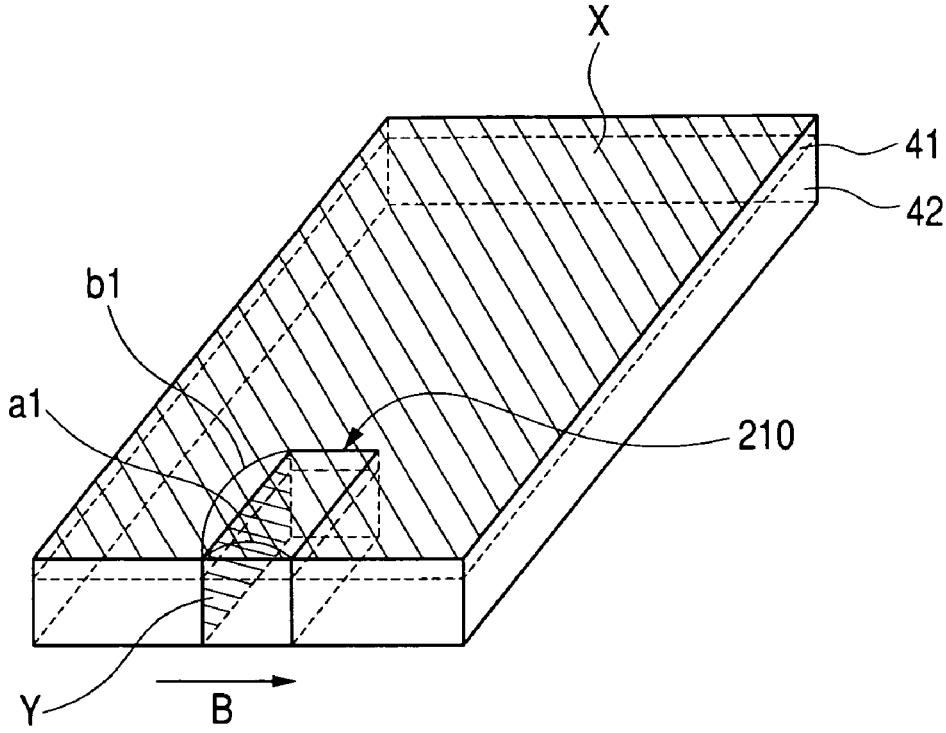
FIG. 8 shows a test piece for measuring the loss tangent tan δ1 of the intermediate transfer member of the present invention.

FIG. 8 shows the test piece 210 cut off from the intermediate transfer member 4.

Let it be assumed that the length a1 of the rotational direction (the direction indicated by the arrow B in FIG. 8) of the intermediate transfer member 4 on the surface X for contacting with the photosensitive member 1 is 2 mm, and the length b1 of a direction perpendicular to the rotational direction of the intermediate transfer member 4 on the surface X for contacting with the photosensitive member 1 is 10 mm. Let it be assumed that the length c1 of a direction perpendicular to the surface X for contacting with the photosensitive member 1 on the surface Y perpendicular to the surface X for contacting with the photosensitive member 1 is 2 mm.

Here, the reason why the surface for contacting with the cleaning blade 19 is included in the test piece 210 is that when the cleaning blade 19 removes the toner on the intermediate transfer member 4, that surface of the intermediate transfer member 4 which contacts with the cleaning blade 19 vibrates. Also, the dimensions of the test piece 210 is adjusted to those of the test piece 200 of the cleaning blade 19 for the convenience of measurement.

Figure 9:
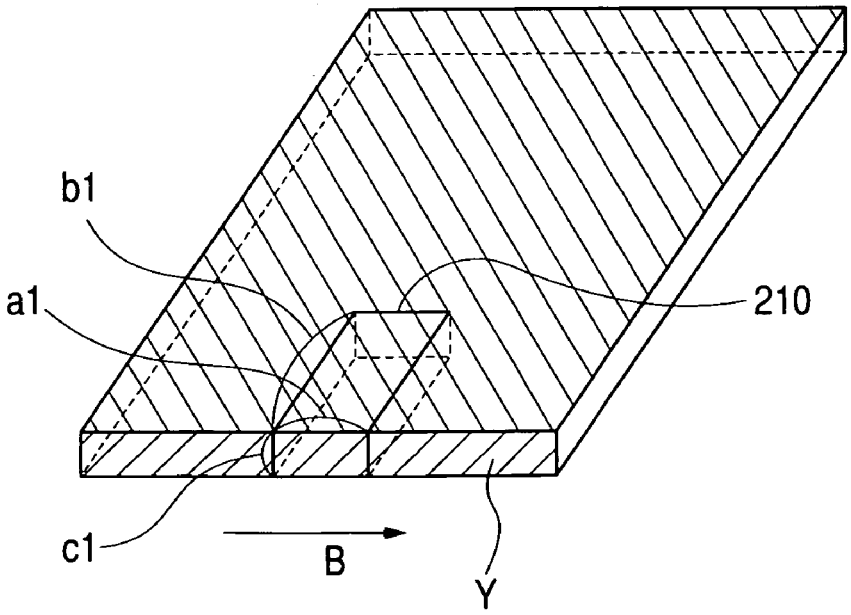
FIG. 9 shows a test piece of another shape for measuring the loss tangent tan δ1 of the intermediate transfer member of the present invention.

When as shown in FIG. 9, the length c1 of the direction perpendicular to the surface for contacting with the image bearing member on the surface Y perpendicular to the surface for contacting with the photosensitive member 1 is less than 2 mm, let it be assumed that the length c1 of the intermediate transfer member 4 itself is the length c1 of the test piece 210.

In the intermediate transfer member 4 of FIG. 9, the length c1 is 1 mm. Accordingly, in the test piece 210, a1=2 mm, b1=10 mm and c1=1 mm.

The loss tangent tan δ1, like the above-described loss tangent tan δ2, is also measured by the use of the viscoelasticity measuring apparatus RSA2 (produced by Rheometrics Co.).

Also, likewise, the temperature of the test piece is kept at 30° C., and vibration of 10 Hz is added in a direction parallel to the edge portion and the loss tangent tan δ1 is measured.

The reason why as the measuring conditions, the frequency of the applied vibration was 10 Hz and the temperature of the test piece 210 was 30° C. is similar to that in the case of the above-described tan δ2.

As the intermediate transfer member 4, five kinds of polyester elastomer materials of the base layer were used as shown in Table 1 below, and the other conditions were set in the same manner as that previously described. tan δ of each material is also described in Table 1. No.3 in Table 1 is the aforedescribed form. Also, in Table 1, ○ means "no occurrence" (good), and X means "occurrence" (bad) (this also holds true in Tables 2 and 3 below).

In Table 1, there is shown the loss tangent tan δ1 of an intermediate transfer member 4 having elasticity and being within a range in which scattering does not occur.

TABLE 1

| No. | polyester elastomer of base layer 42 | tanδ1 of intermediate transfer member 4 | scattering during transfer from photosensitive member 1 to intermediate transfer member 4 |
|---|---|---|---|
| 1 | Hytrel 2751 | 0.03 | X |
| 2 | Hytrel 7247 | 0.05 | ○ |
| 3 | Hytrel 5557 | 0.25 | ○ |
| 4 | Hytrel 4767 | 0.4 | ○ |
| 5 | Hytrel 3046 | 0.5 | X |

From this result, to prevent the occurrence of the scattering during the transfer from the photosensitive member to the intermediate transfer member 4, it is necessary that $0.05 \leqq \tan \delta 1 \leqq 0.40$.

As the cleaning blade 19, six kinds of times for which it was immersed in the MDI bath were set as shown in Table 2 below, and the other conditions were set in the same manner as that previously described. The loss tangent of each cleaning blade is also described in Table 2. In Table 2, the presence or absence of the occurrence of faulty cleaning was inspected by the use of the intermediate transfer member No.3 in Table 1.

TABLE 2

| No. | time for which the material was immersed in MDI bath | loss tangent tanδ2 of cleaning blade 19 | faulty cleaning |
|---|---|---|---|
| 1 | none(0 minute) | 0.1 | X |
| 2 | 1 min. | 0.15 | ○ |
| 3 | 3 min. | 0.2 | ○ |
| 4 | 5 min. | 0.3 | ○ |
| 5 | 10 min. | 0.4 | ○ |
| 6 | 20 min. | 0.5 | X |

The transferring performance and the cleaning performance after the passing of 50,000 sheets were evaluated by the use of image forming apparatuses using the above-described various intermediate transfer members 4 and cleaning blades 19.

When like No.1 in Table 1, tan δ1 of the intermediate transfer member 4 is 0.03, tan δ1 is too small and the intermediate transfer member 4 cannot be deformed in conformity with the unevenness of the toner image on the photosensitive member 1. In the outline portion of the toner image on the photosensitive member 1, a gap formed between the intermediate transfer member 4 and the photosensitive member 1 and scattering occurred.

Also, when like No.5 in Table 1, tan δ1 of the intermediate transfer member 4 is 0.50, tan δ1 is too great and much time is required for the intermediate transfer member 4 to be formed. Accordingly, much time is required until the intermediate transfer member 4 is deformed so as to be along the unevenness formed by the toner image on the photosensitive member 1, and in the outline portion of the toner image, a gap formed between the photosensitive member 1 and the intermediate transfer member 4 and scattering occurred.

On the other hand, when like Nos. 2 to 4 in Table 1, tan δ1 of the intermediate transfer member 4 is within the range of 0.05 to 0.40 ($0.05 \leqq \tan \delta 1 \leqq 0.40$), the intermediate transfer member 4 can be quickly deformed so as to be along the unevenness formed by the toner image on the photosensitive member 1. Consequently, scattering does not occur.

In a case where use is made of the intermediate transfer members 4 like Nos. 2 to 4 in Table 1, when like No.1 in Table 2, the total tan δ2-2 of the hardened layer and base body of the cleaning blade 19 in the vicinity of the abutting portion is 0.10, the loss tangent tan δ2 of the cleaning blade 19 is too small and the behavior when the cleaning blade 19 moved in conformity with the vibration of the intermediate transfer member 4 is not quickly attenuated, and the contact property of the cleaning blade 19 with the intermediate transfer member 4 is bad, and faulty cleaning occurred.

Also, when like No.6 in Table 2, the loss tangent tan δ2 of the cleaning blade 19 in the vicinity of the abutting portion is 0.50, the loss tangent tan δ2 of the cleaning blade 19 is too great and therefore, the time required for the deformation thereof becomes long. Here, the cleaning belt 19 could not be deformed so as to be along the unevenness of the surface of the intermediate transfer member 4, and faulty cleaning occurred.

Therefore, in a case where use is made of the intermediate transfer members 4 like Nos. 2 to 4 in Table 1, when like Nos. 2 to 5 in Table 2, the loss tangent tan δ2 of the cleaning blade 19 in the vicinity of the abutting portion is within the range of 0.15 to 0.40 ($0.15 \leqq \tan \delta 2 \leqq 0.40$), the contact property of the cleaning blade 19 with the intermediate transfer member 4 becomes good and also, it becomes possible for the cleaning blade 19 to be deformed along the unevenness of the surface of the intermediate transfer member 4. Consequently, the occurrence of faulty cleaning could be suppressed.

Even if use was made of the intermediate transfer members 4 of Nos. 2 to 4 in Table 1 and use was made of the cleaning blades 19 of Nos. 2 to 4 in Table 2, there was a case where good cleaning performance was not obtained. It depends on the combination of each intermediate transfer member and each cleaning blade.

Table 3 below shows the result of the cleaning performance after the passing of 50,000 sheets when the above-described intermediate transfer members and cleaning blades were combined.

TABLE 3

| tanδ1 of intermediate transfer member | loss tangent tanδ2 of cleaning blade 19 | faulty cleaning | sum of loss tangent (tanδ1 + tanδ2) |
|---|---|---|---|
| 0.05 | 0.15 | X | 0.2 |
| | 0.2 | ○ | 0.25 |
| | 0.3 | ○ | 0.35 |
| | 0.4 | ○ | 0.45 |
| 0.25 | 0.15 | ○ | 0.4 |
| | 0.2 | ○ | 0.45 |
| | 0.3 | ○ | 0.55 |
| | 0.4 | ○ | 0.65 |
| 0.4 | 0.15 | ○ | 0.55 |
| | 0.2 | ○ | 0.6 |
| | 0.3 | X | 0.7 |
| | 0.4 | X | 0.8 |

In a case where use is made of the intermediate transfer members 4 like Nos. 2 to 4 in Table 1, when the sum of the loss tangent tan δ1 of the intermediate transfer member 4 and the loss tangent tan δ2 of the cleaning blade 19 (=tan δ1+tan δ2) is 0.20, the loss tangent is too small and the relative vibration of the cleaning blade 19 and the intermediate transfer member 4 at the abutting portion is not quickly attenuated, and a gap forms between the cleaning blade 19 and the intermediate transfer member 4 and faulty cleaning occurs.

When the sum of the loss tangent of the intermediate transfer member 4 and the loss tangent of the cleaning blade 19 (=tan δ1+tan δ2) was 0.25 or greater, faulty cleaning did not occur.

Also, when the sum of the loss tangent tan δ1 of the intermediate transfer member 4 and the loss tangent tan δ2 of the cleaning blade 19 (=tan δ1+tan δ2) is 0.70 or 0.80, the sum of the loss tangent tan δ1 of the intermediate transfer member 4 and the loss tangent tan δ2 of the cleaning blade 19 is great, and much time is required for the intermediate transfer member 4 and the cleaning blade 19 to be deformed along the unevenness of the surface of the intermediate transfer member 4. Accordingly, the intermediate transfer member 4 and the cleaning blade 19 could not be deformed along the unevenness of the surface of the intermediate transfer member 4, and a gap formed between the intermediate transfer member 4 and the cleaning blade 19 and faulty cleaning occurred.

When the sum of the loss tangent tan δ1 of the intermediate transfer member 4 and the loss tangent tan δ2 of the cleaning blade 19 (=tan δ1+tan δ2) was 0.65 or less, the result was good.

Therefore, in a case where use is made of the intermediate transfer members 4 like Nos. 2 to 4 in Table 1, when the sum of the loss tangent tan δ1 of the intermediate transfer member 4 and the loss tangent tan δ2 of the cleaning blade 19 (=tan δ1+tan δ2) is within the range of 0.25-0.65 ($0.25 \leqq \tan \delta 1 + \tan \delta 2 \leqq 0.65$), the two members have a vibration attenuating property and also, it becomes possible for them to be deformed correspondingly to the unevenness of the surface, and there can be obtained a good cleaning characteristic free of faulty cleaning.

Also, in a case where as the image bearing member, use is made of a photosensitive member 1 of which the loss tangent tan δ1 is $0.05 \leqq \tan \delta 1 \leqq 0.40$ and as the blade member, use is made of a photosensitive member cleaning blade of which the loss tangent tan δ2 is $0.15 \leqq \tan \delta 2 \leqq 0.40$, $0.25 \leqq \tan \delta 1 + \tan \delta 2 \leqq 0.65$ is adopted, whereby a similar effect can be obtained.

Second Embodiment

A second embodiment of the present invention will now be described.

This embodiment is an example in which the present invention is applied to an image forming apparatus differing from the first embodiment. The image forming apparatus is shown in FIG. 10.

Figure 10:
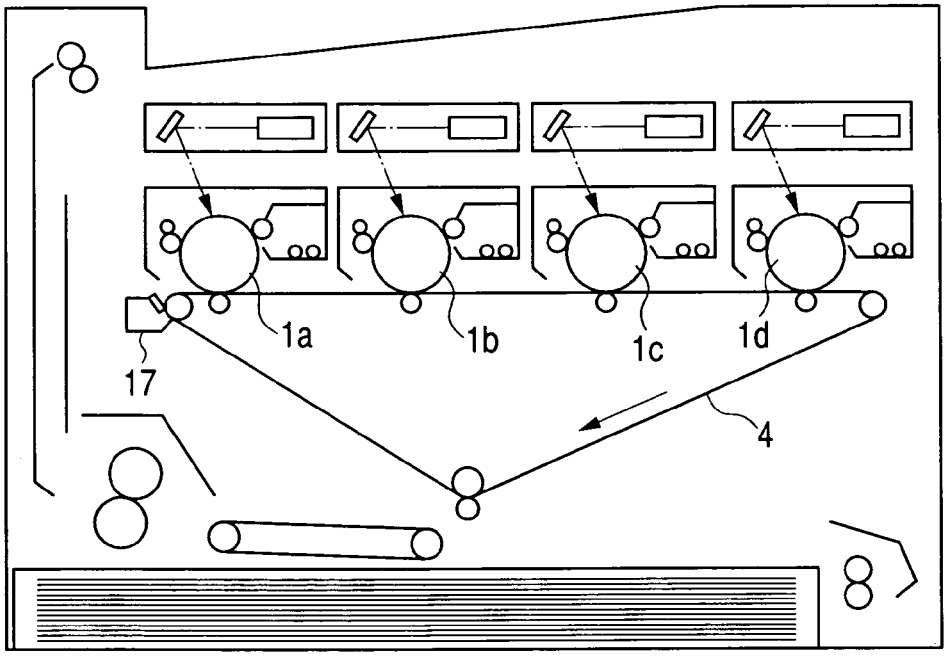
FIG. 10 is a schematic cross-sectional view of an image forming apparatus according to a second embodiment of the present invention.

The image forming process of the image forming apparatus according to the present embodiment shown in FIG. 10 is substantially the same as that of the image forming apparatus according to the first embodiment and therefore need not be described.

As a feature of the image forming apparatus according to the present embodiment, it may be mentioned that it is a tandem system having four photosensitive members 1*a*, 1*b*, 1*c* and 1*d* and is excellent in high speed property. On the respective photosensitive members 1*a*-1*d*, charging, latent image forming and developing steps are carried out to thereby form toner images of respective colors, and these toner images are successively superposed on the intermediate transfer member 4, and the toner images on the intermediate transfer member 4 are collectively transferred to a transfer material to thereby obtain a color image.

Thus, the image forming apparatus according to the present embodiment is provided with a cleaning apparatus 17 for cleaning the intermediate transfer member 4, but adopts a cleaningless type having no cleaning apparatus for cleaning the photosensitive members 1*a*-1*d*.

Again in such an image forming apparatus, there is obtained an effect similar to that of the aforedescribed first embodiment.

Third Embodiment

A third embodiment of the present invention will now be described.

Figure 11:
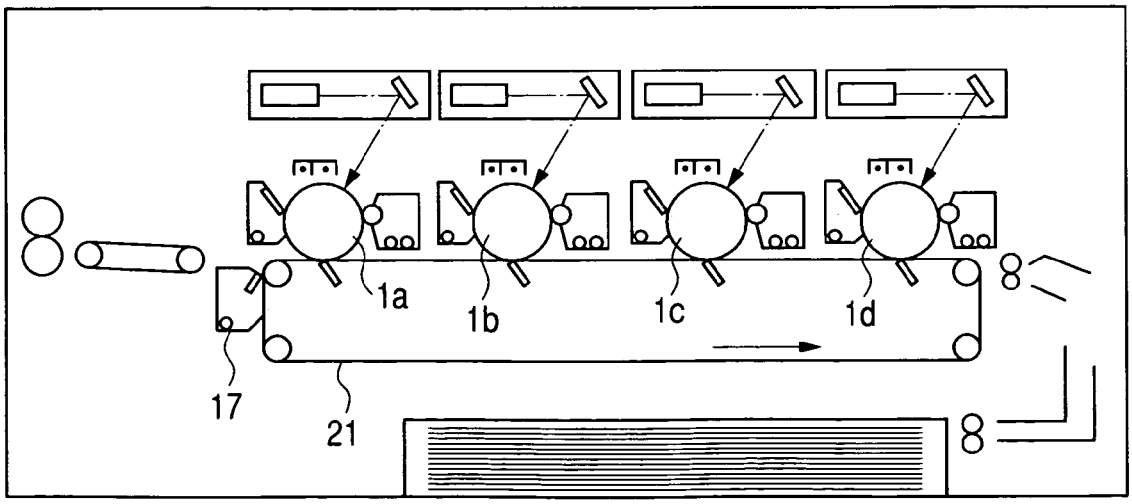
FIG. 11 is a schematic cross-sectional view of an image forming apparatus according to a third embodiment of the present invention.

This embodiment is an example in which the present invention is applied to an image forming apparatus differing from the first embodiment. The image forming apparatus is shown in FIG. 11.

The image forming process of the image forming apparatus according to the present embodiment is substantially the same as that of the image forming apparatus according to the aforedescribed first embodiment and therefore need not be described.

As a feature of the image forming apparatus according to the present embodiment, it may be mentioned that it is an image forming apparatus of a tandem system having four photosensitive members 1*a*, 1*b*, 1*c* and 1*d*, and is excellent in high speed property. In this image forming apparatus, on the respective photosensitive members 1*a*-1*d*, charging, latent image forming and developing steps are carried out to thereby form toner images of respective colors, and these toner images are successively superimposed on a transfer material on a direct transfer belt 21 to thereby obtain an image. The direct transfer belt 21 is provided with a cleaning apparatus 17 for removing any toners overflowing or scattering from the end portions of the transfer material or the fog toners between transfer materials.

Again in such an image forming apparatus, there is obtained an effect similar to that of the aforedescribed first embodiment.

This application claims priority from Japanese Patent Application No. 2003-302231 filed Aug. 27, 2003, which is hereby incorporated by reference herein.

What is claimed is:

1. An image forming apparatus comprising:

an image bearing member for bearing a toner image;

an intermediate transfer belt to which the toner image is transferred, a loss tangent of said intermediate transfer belt being tan $\delta 1$, said intermediate transfer belt having a plurality of layers including a rubber layer;

primary transferring means for transferring the toner image borne on said image bearing member to said intermediate transfer belt;

secondary transferring means for transferring the toner image borne on said intermediate transfer belt to a recording medium; and a blade member of which an edge contacts with said intermediate transfer belt and removes toner residual on said intermediate transfer belt after the toner image has been transferred from said intermediate transfer belt to the recording medium, and a loss tangent of said blade member being tan $\delta 2$, a line pressure of said blade member against said intermediate transfer belt being N (g/cm), and said blade member having a layer of a polyurethane resin hardened by being immersed in isocyanate, wherein the loss tangent tan $\delta 1$ is measured by use of a first test piece formed by cutting off a portion of said intermediate transfer belt, said first test piece having said plurality of layers including said rubber layer, said first test piece includes a surface contacting with said blade member, wherein the loss tangent tan $\delta 2$ is measured by use of a second test piece formed by cutting off a portion of said blade member, said second test piece having said hardened layer, said second test piece includes said edge contacting with said intermediate transfer belt, and two surfaces forming said edge, and wherein the following relations are satisfied:

$0.05 \leqq \tan \delta 1 \leqq 0.40$, $0.15 \leqq \tan \delta 2 \leqq 0.40$, $20 < N < 60$, and $0.25 \leqq \tan \delta 1 + \tan \delta 2 \leqq 0.65$.

2. An image forming apparatus according to claim 1, wherein an abutting angle $\theta$ (degrees) of said blade member against said intermediate transfer belt is $15 \leqq \theta \leqq 35$.

* * * * *

UNITED STATES PATENT AND TRADEMARK OFFICE

CERTIFICATE OF CORRECTION

PATENT NO. : 7,245,864 B2
APPLICATION NO. : 10/924984
DATED : July 17, 2007
INVENTOR(S) : Motohiro Fujiwara It is certified that error appears in the above-identified patent and that said Letters Patent is hereby corrected as shown below:

COLUMN 3:

Line 24, “is caused.” should read --is caused--.

COLUMN 5:

Line 50, “great deal” should read --great amount--;
Line 57, “dogged” should read --clogged--; and
Line 62, “preferable” should read --preferably--.

COLUMN 6:

Line 25, “diphenylmethaneisocianate” should read --diphenylmethane isocyanate--.
Line 50, “4,4-diphenylmethanediisocianate” should read --4,4-diphenylmethane diisocyanate--;
Line 51, “group/isocianate” should read --group/isocyanate--; and
Line 58, “4,4-dephenilmethaneisocianate” should read --4,4-diphenylmethane isocyanate--.

COLUMN 8:

Line 2, “for example,” should read --for example, of--;
Line 4, “rubber chloroprene” should read --rubber, chloroprene--;
Line 5, “nitrile rubber” should read --nitrile rubber,--;
Line 24, “follows. 100 parts” should read --follows. ¶ 100 parts--; and
Line 31, “isocianate” should read --isocyanate--.

COLUMN 9:

Line 50, “transfer. member” should read --transfer member--.

COLUMN 10:

Line 29, “tangent tand2” should read --tangent tan δ2--.

UNITED STATES PATENT AND TRADEMARK OFFICE

CERTIFICATE OF CORRECTION

PATENT NO. : 7,245,864 B2
APPLICATION NO. : 10/924984
DATED : July 17, 2007
INVENTOR(S) : Motohiro Fujiwara It is certified that error appears in the above-identified patent and that said Letters Patent is hereby corrected as shown below:

COLUMN 11:

Line 31, "is adjusted" should read --are adjusted--;
Line 52, "why as the" should read --why is the--; and
Line 54, "30° C. Is similar" should read --30° C, are similar--.

Signed and Sealed this

Fifteenth Day of April, 2008

JON W. DUDAS
*Director of the United States Patent and Trademark Office*